US007727026B2

(12) United States Patent
Qin et al.

(10) Patent No.: US 7,727,026 B2
(45) Date of Patent: Jun. 1, 2010

(54) ELECTRICAL CONNECTOR WITH A PAIR OF IMPROVED DETECTING PINS

(75) Inventors: Fa-Xiang Qin, Kunshan (CN); Zhen-Sheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,358

(22) Filed: Sep. 29, 2008

(65) Prior Publication Data

US 2009/0098772 A1 Apr. 16, 2009

(30) Foreign Application Priority Data

Oct. 12, 2007 (CH) ..... 2007 2 0043638 U

(51) Int. Cl.
*H01R 24/00* (2006.01)
*H01R 33/00* (2006.01)

(52) U.S. Cl. ..... 439/660; 439/607.34

(58) Field of Classification Search ..... 439/660, 439/607.34, 607.35, 607.4
See application file for complete search history.

(56) References Cited

U.S. PATENT DOCUMENTS 5,674,085 A 10/1997 Davis et al.
5,800,192 A 9/1998 David et al.
6,296,521 B1 * 10/2001 Chang et al. ..... 439/607.4
6,945,824 B1 * 9/2005 Li et al. ..... 439/660
7,207,819 B2 * 4/2007 Chen ..... 439/188
7,210,945 B1 * 5/2007 Ying ..... 439/79
7,255,607 B1 * 8/2007 Wu ..... 439/660
7,413,467 B1 * 8/2008 Lai et al. ..... 439/489
2005/0176306 A1 * 8/2005 Zhu et al. ..... 439/660
2009/0061671 A1 * 3/2009 Qin et al. ..... 439/188
2009/0075517 A1 * 3/2009 Li et al. ..... 439/552

FOREIGN PATENT DOCUMENTS

TW 497768 8/2002
TW M288046 2/2006
TW M318233 9/2007

* cited by examiner

*Primary Examiner*—Hae Moon Hyeon
(74) *Attorney, Agent, or Firm*—Andrew C. Cheng; Wei Te Chung; Ming Chieh Chang

(57) ABSTRACT

An electrical connector includes an insulating housing defining a base portion and a tongue portion extending forwards from a front face of the base portion and a plurality of terminals. The tongue portion defines a recess portion at each of opposite end walls thereof. Each terminal defines a solder portion extending towards a bottom face of the base portion and a contacting portion located on the tongue portion. A pair of detecting pins are located in recess portions and each comprises a leg portion extending out the base portion and an arc section projecting out beyond the end wall of the tongue portion to be touched by a sidewall of a shielding shell of a counter connector when the electrical connector is inserted by the counter connector.

9 Claims, 6 Drawing Sheets

ELECTRICAL CONNECTOR WITH A PAIR OF IMPROVED DETECTING PINS

BACKGROUND OF THE INVENTION

1. Field of the Invention

The present invention relates to an electrical connector having a pair of detecting pins.

2. Description of Related Art

U.S. Pat. No. 5,674,085 discloses an electrical connector having an insulating housing defining a tongue portion, a shielding shell surrounding the housing and conductive terminals in the tongue portion and a detecting pin. The detecting pin is retained in the housing and has a cantilever portion bent and extending below the tongue portion. The cantilever portion will engage with one conductive terminal when a mating connector is inserted into the connector.

However, electrical reliability of the terminals will face challenge since the terminal functions as a detecting pin synchronously. The cantilever is longer so that it might be permanently distorted.

Therefore, an electrical connector with improved detecting pins is desired to overcome the disadvantages of the related arts.

SUMMARY OF THE INVENTION

An object of the present invention is to provide an electrical connector with a pair of improved detecting pins.

In order to achieve above-mentioned object, an electrical connector includes an insulating housing defining a base portion and a tongue portion extending forwards from a front face of the base portion and a plurality of terminals. The tongue portion defines a recess portion at each of opposite end walls thereof. Each defines a solder portion extending towards a bottom face of the base portion and a contacting portion located on the tongue portion. A pair of detecting pins are located in recess portions and each comprises a leg portion extending out the base portion and an arc section projecting out beyond the end wall of the tongue portion to be touched by a sidewall of a shielding shell of the counter connector when the electrical connector is inserted by the counter connector.

Other objects, advantages and novel features of the present invention will become more apparent from the following detailed description of the present embodiment when taken in conjunction with the accompanying drawings.

DETAILED DESCRIPTION OF THE INVENTION

Figure 1:
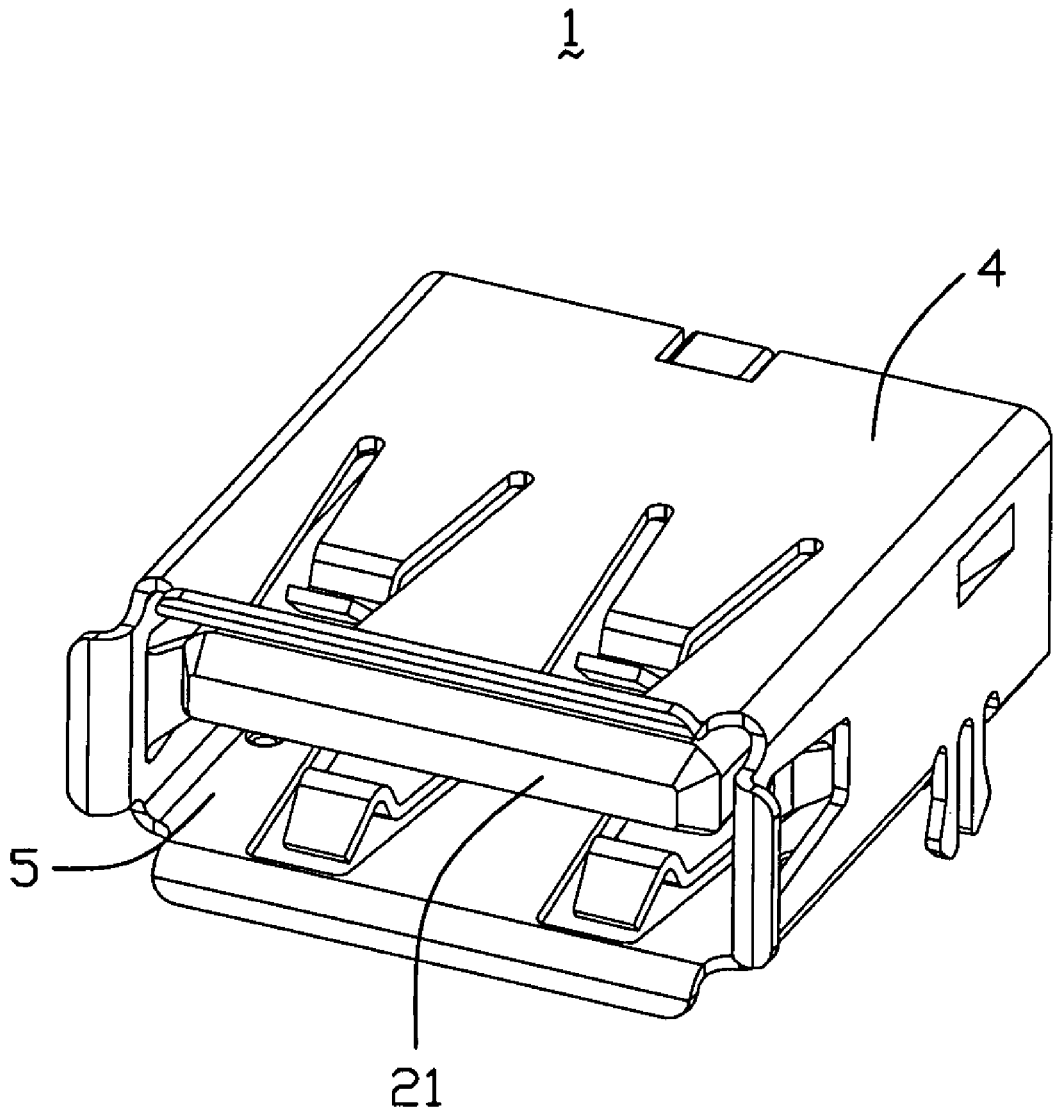
FIG. 1 is a top and front perspective view of an electrical connector of a first embodiment.

Reference will now be made to the drawing figures to describe a preferred embodiment of the present invention in detail.

Figure 2:
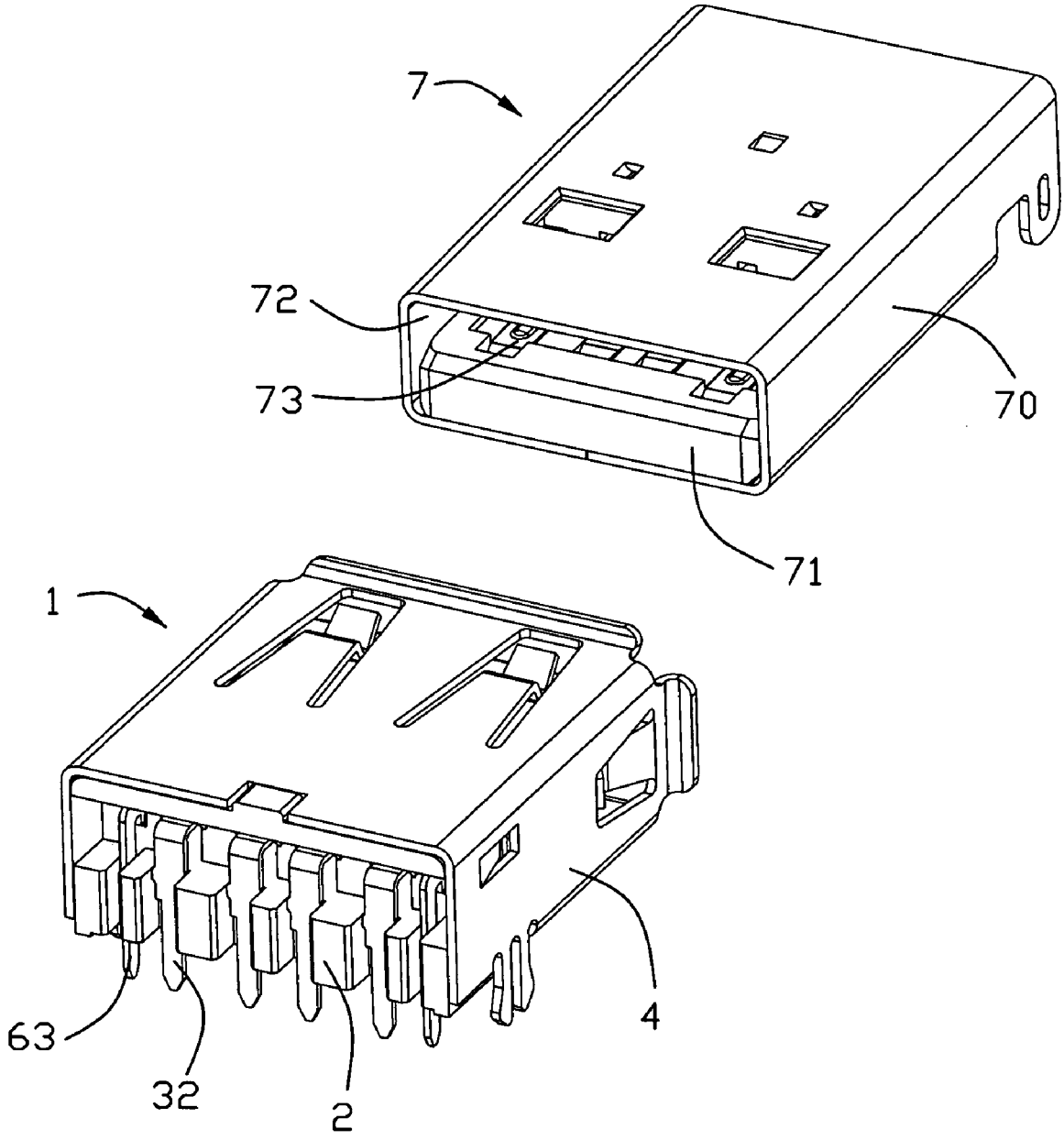
FIG. 2 is a perspective view of the electrical connector and a counter connector.

Referring to FIGS. 1 and 2, an electrical connector 1 of a first embodiment of the present invention is used to mate with a counter connector 7. The counter connector 7 comprises an insulating housing having a front mating tongue portion 71 and a shielding shell 70 surrounding the housing to define a mating cavity between the tongue portion 71, the top wall and sidewalls 72 of the shell 70. A plurality of terminals 73 are arranged on the top surface of the tongue portion 71.

Figure 3:
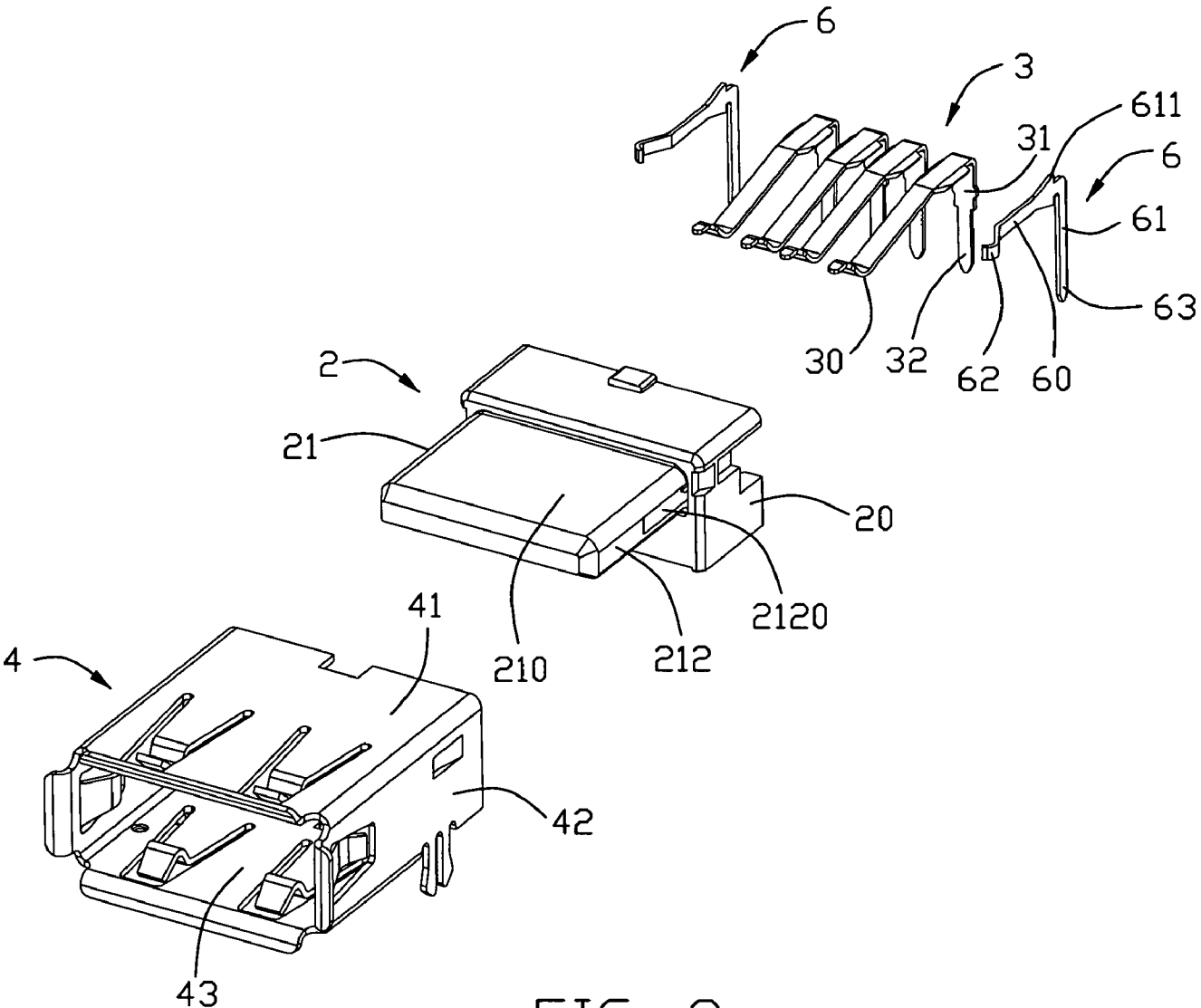
FIG. 3 is an exploded perspective view of the electrical connector shown in FIG. 1.
Figure 4:
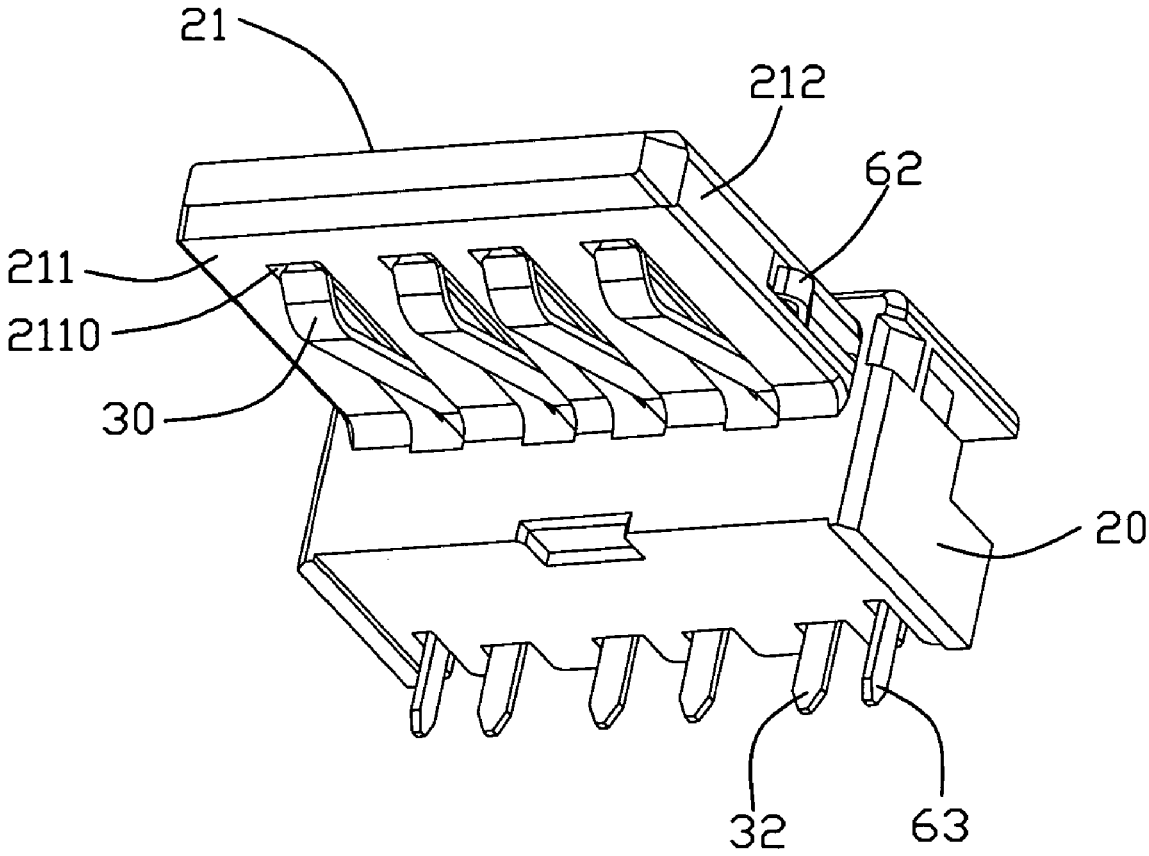
FIG. 4 is a perspective view of the connector without the shell thereon shown in FIG. 1.

Referring to FIGS. 3 and 4, the connector comprises an insulating housing 2, a plurality of spring terminal 3, a shielding shell 4 and two spring detecting pins 6. The insulating housing 2 made from resin material, comprises a base portion 20 and a tongue portion 21 extending forward from a front face of the base portion. The tongue portion 21 defines a top surface 210 and a bottom surface 211 forming two opposite large main surfaces and two opposite end surfaces 212 forming two opposite tiny side surface perpendicular to said two opposite main surfaces. The four terminals 3 are retained in corresponding passageways 2110 on the bottom surface 211 of the tongue portion and each comprises a retaining portion 31 retained in the base portion, a solder portion 32 extending downwards from the retaining portion and toward a bottom face 201 of the base portion 20 and a contacting portion 30 extending forward from the retaining portion. The shielding shell 4 surrounds and is retained on the base portion 20 and spacedly surrounds the tongue portion 21 to define a receiving cavity 43. The shell comprises a top wall 41, a bottom wall and two sidewalls 42 perpendicularly connecting with the top and bottom wall to commonly define said receiving cavity 43.

Referring to FIGS. 3 and 4, the tongue portion 21 of the housing defines a recess portion 2120 at each end surface 212 into which the two detecting pins 6 are inserted. The recess portion 2120 adjacent to the rear portion of the tongue portion 21, opens outward and runs through the base portion rearwards. The detecting pin 6, made from a metal slit tape and received in the recess portion 2120, comprises a retaining section 61, a leg portion 63 extending downwards from the retaining section and a contacting arm 60 from the retaining section. The retaining section has at least one tab 611 at an upper and lower edge thereof and retained in the base portion of the housing. The contacting arm 60 defines an outwards-projecting arc shaped contacting section 62 at a front end thereof and the contacting section 62 projects outwards beyond the end surface 212 of tongue portion and toward the sidewalls of the shell.

As shown in FIG. 2, the detecting pins 60 respectively touch the inside of sidewalls 72 of the shell 70 of the counter connector 7 to complete an electrical connection and the inside of the shell 4 touch the outside of sidewalls 72 of the shell 70.

Figure 5:
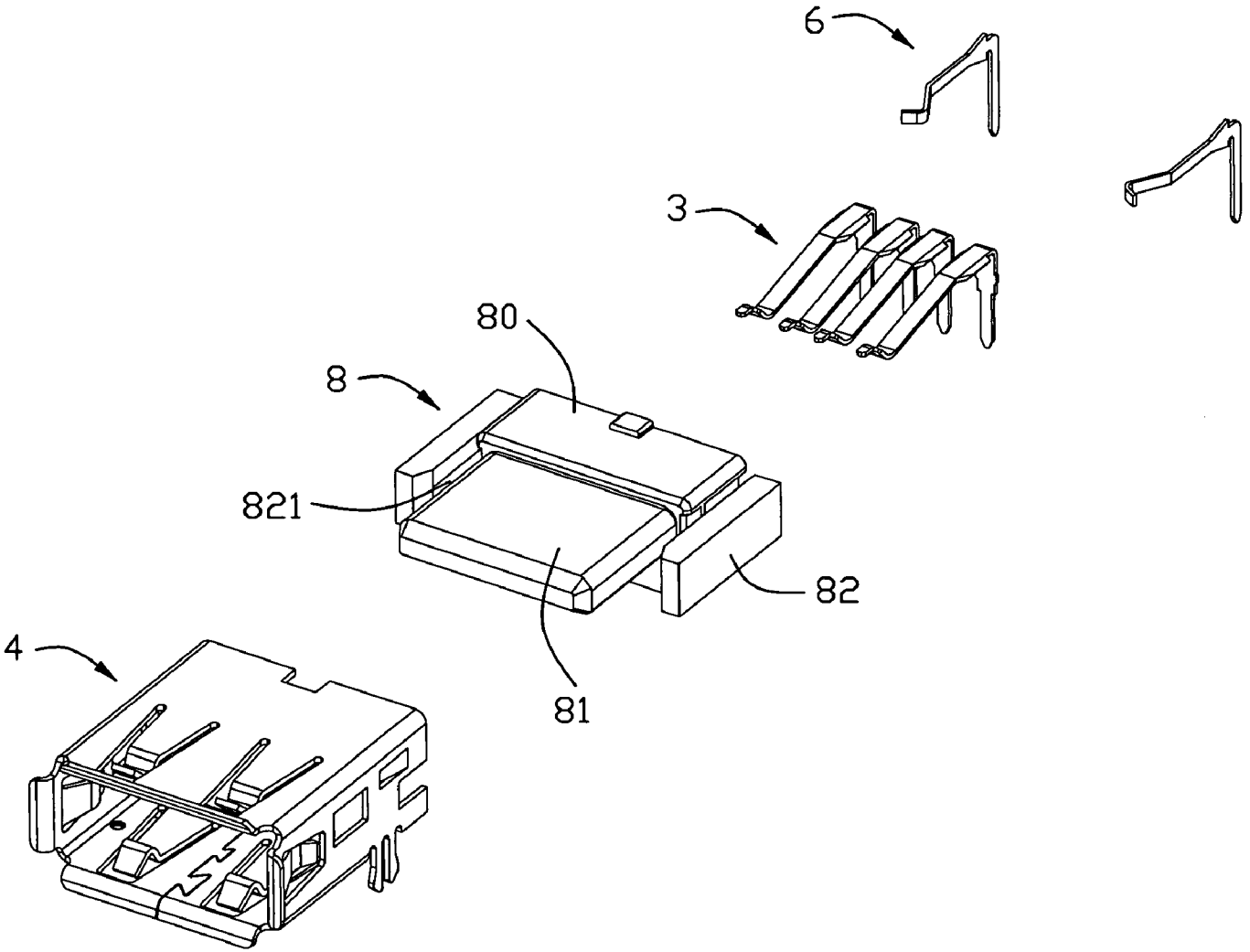
FIG. 5 is an exploded perspective view of an electrical connector of a second embodiment.
Figure 6:
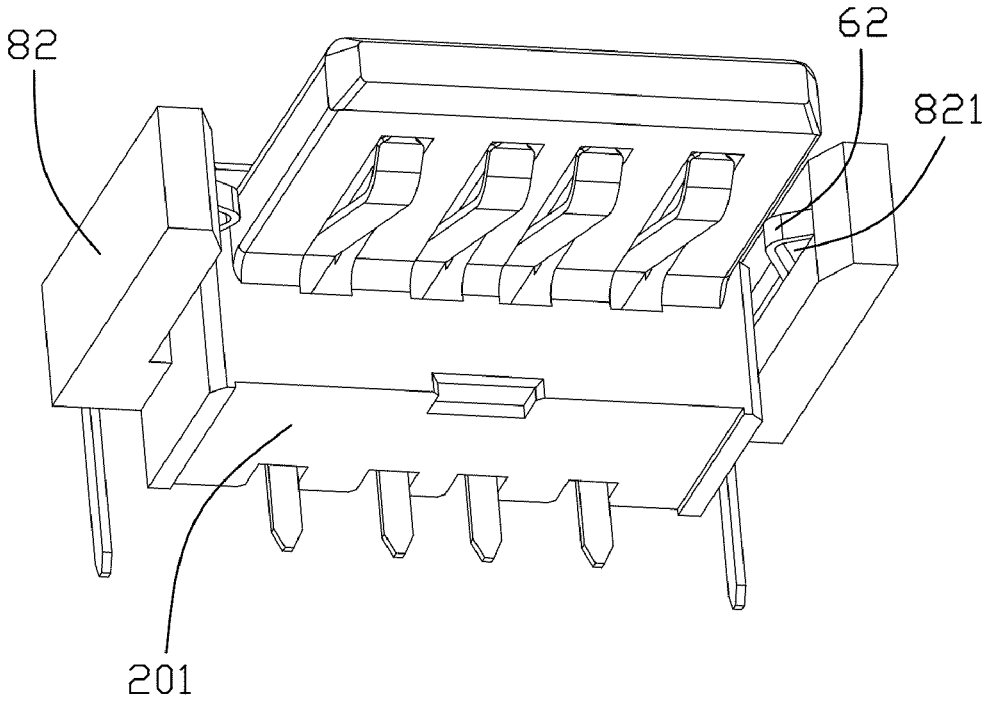
FIG. 6 is a perspective view of the connector without the shell thereon shown in FIG. 5.

Another embodiment of an electrical connector is provided in FIGS. 5 and 6. An insulating housing 8 of the electrical connector comprises a base portion 80 and a tongue portion 81 extending forward from the front surface thereof adjacent to the top thereof. A flange 82 parallel extends forward from each end wall of the base portion 80 and beyond the front surface of the base portion. Each flange defines a recess portion 821 in the inside thereof, which opens inwards and rearward runs through the base portion. The pair of detecting pins 6 are received in the recess portions 821 of the flange and the arc portions 62 of the detecting pins project towards the tongue portion. The detecting pins 60 respectively touch the outside of end walls 70 of the shell of the counter connector 7 to complete an electrical connection and the inside of the shell 4 touch the outside of the shell 70 of the shell 7.

However, the disclosure is illustrative only, changes may be made in detail, especially in matter of shape, size, and arrangement of parts within the principles of the invention.

What is claimed is:

1. An electrical connector comprising:

an insulating housing defining a base portion and a tongue portion extending forwards from a front face of the base portion, the tongue portion defining a recess portion at each of opposite end walls thereof;

a plurality of terminals, each defining a solder portion extending towards a bottom face of the base portion and a contacting portion located on the tongue portion; and a pair of detecting pins being located in recess portions, each comprising a leg portion extending out the base portion and an arc section projecting out beyond the end wall of the tongue portion to be touched by a sidewall of a shielding shell of a counter connector when the electrical connector is inserted by the counter connector.

2. The electrical connector as described in claim 1, wherein each detecting pin comprises a retaining portion with at least one tab on an upper and lower edge thereof and a contacting arm straightly extending forward from the retaining portion with the arc section at a front end thereof.

3. The electrical connector as described in claim 2, wherein a leg portion extends downward from the retaining portion.

4. The electrical connector as described in claim 3, wherein the terminals are located in a bottom surface of the tongue portion.

5. The electrical connector as described in claim 4, further comprising a shielding shell retained on the base portion and surrounding the tongue portion to define a receiving cavity, the arc section projects towards the sidewalls of the shielding shell.

6. An electrical connector comprising:

an insulating housing defining a base portion, a tongue portion extending forwards from a front face of the base portion and a pair of flanges located spaced from and parallel to two opposite end walls of the tongue portion, the flanges defining a recess portion at each of opposite inside surfaces thereof;

a plurality of terminals, each defining a solder portion extending towards a bottom face of the base portion and a contacting portion located on the tongue portion; and a pair of detecting pins being located in said recess portions, each comprising a leg portion extending out the base portion and an arc section projecting out beyond the inside surfaces of the flanges to be touched by a sidewall of a shielding shell of a counter connector when the electrical connector is inserted by the counter connector.

7. The electrical connector as described in claim 6, wherein each detecting pin comprises a retaining portion with at least one tab on an upper and lower edge thereof and a contacting arm straightly extending forward from the retaining portion with the arc section at a front end thereof.

8. An electrical connector comprising:

a frame like metallic shell defining a pair of opposite main walls and a pair of opposite side walls commonly defining a cavity;

an insulative housing received in the cavity and defining a base with a mating tongue extending forwardly therefrom, said mating tongue defining two opposite large main surfaces and two opposite tiny side surfaces perpendicular to said two opposite main surfaces, said main surfaces and said side surfaces commonly extending in a front-to-back direction from peripheral edges of a front face of the mating tongue, respectively;

a plurality of spring contacts disposed in the housing with contacting sections exposed upon one of said large main surface for imposing an asymmetric force upon a complementary connector, which is inserted into the cavity, in a vertical direction perpendicular to the front-to-back direction and main surface while parallel to the side surface; and a pair of spring detecting terminals located around said two opposite tiny side surfaces, respectively, so as to impose essentially balanced and symmetric forces upon a metallic shield of said complementary connector along a transverse direction parallel to said large main surface while perpendicular to said side surface and said front-to-back direction and said vertical direction.

9. The electrical connector as claimed in claim 8, wherein said pair of spring detecting terminals is located on a pair of flanges of the housing, which are opposite to and spaced from the two corresponding side surfaces, respectively, to impose the corresponding forces upon the shield of the complementary connector in opposite direction toward each other.

* * * * *